United States Patent [19]

Kolbe

[11] 4,212,749

[45] Jul. 15, 1980

[54] LIQUID PREPARATION OF FATTY ACID/ALKANOLAMINE CONDENSATES

[75] Inventor: Joachim Kolbe, Bergisch-Neukirchen, Fed. Rep. of Germany

[73] Assignee: Bayer Aktiengesellschaft, Leverkusen, Fed. Rep. of Germany

[21] Appl. No.: 801,916

[22] Filed: May 31, 1977

Related U.S. Application Data

[63] Continuation of Ser. No. 592,899, Jul. 3, 1975, abandoned.

[30] Foreign Application Priority Data

Jul. 5, 1974 [DE] Fed. Rep. of Germany ..... 2432296

[51] Int. Cl.[2] ..... D06M 13/18; D06M 13/16

[52] U.S. Cl. ..... 252/8.75; 252/8.7; 252/8.8; 252/8.9; 252/532; 252/551

[58] Field of Search ..... 252/8.75, 8.7, 8.8, 252/8.9, 532, 551

[56] References Cited

U.S. PATENT DOCUMENTS

| | | | |
|---|---|---|---|
| 2,205,042 | 6/1940 | Lenher et al. | 252/8.75 |
| 2,950,255 | 8/1960 | Goff | 252/8.75 X |
| 3,336,222 | 8/1967 | Schaaf et al. | 252/8.75 X |
| 3,391,985 | 7/1968 | Zurbuchen et al. | 8/55 |
| 3,503,698 | 3/1970 | Zurbuchen et al. | 8/41 |
| 3,681,241 | 8/1972 | Rudy | 252/8.75 |
| 3,839,393 | 10/1974 | Steckler | 252/8.75 X |
| 3,954,679 | 5/1976 | Wixon | 252/555 |

FOREIGN PATENT DOCUMENTS 6803354 11/1969 South Africa .

*Primary Examiner*—Carman J. Seccuro

*Attorney, Agent, or Firm*—Sprung, Felfe, Horn, Lynch & Kramer

[57] ABSTRACT

Liquid, aqueous preparations of fatty acid/alkanolamine condensates containing a sulphuric acid ester of the general formula $$R—X—OSO_3^{(-)}M^{(+)}$$

wherein

R denotes an aliphatic radical with 8–22 C atoms; an alkylphenyl radical with 4–12 C atoms in the alkyl chain or a naphthyl radical, X denotes a polyglycol ether chain which is derived from ethylene oxide or propylene oxide or mixtures of both, and wherein the number of chain members is 10–30 and $M^{(+)}$ denotes a metal of main group 1 or an ammonium ion.

4 Claims, No Drawings

LIQUID PREPARATION OF FATTY ACID/ALKANOLAMINE CONDENSATES

This is a continuation of application Ser. No. 529,899 filed July 3, 1975, and now abandoned.

The condensation products of fatty acids and alkanolamines which, depending on the conditions under which they are prepared, and the molar ratios of the reactants, consist of varying amounts of the corresponding amides, amino-esters and ester-amides have long been regarded as well-proven textile softeners (K. Lindner "Tenside-Textilhilfsmittel-Waschrohstoffe" ("Surface-active Agents/Textile Auxiliaries/Detergent Raw Materials"), 2nd edition, volume 1, pages 491, 904 and 979). Their preparation is known, for example, from U.S. Pat. No. 2,173,053. For technological reasons, particularly because they dissolve more rapidly in water when the treatment liquor is being prepared, such products are as a rule employed as aqueous preparations. An essential disadvantage is that these preparations, even when they contain 80% of water, still have a pasty consistency, which makes their use, and especially their automatic metering, very difficult or impossible.

Various methods for reducing the viscosity of surface-active substances are known from the literature. Thus, German Offenlegungsschrift (German Published Specification) No. 2,205,337 describes lowering the viscosity of fatty alcohol polyglycol ethers by adding anionic compounds, especially Na xylenesulphonate, sulphated oleic acid methyl ester or cetyl/oleyl sulphate. According to German Offenlegungsschrift (German Published Specification) No. 2,326,006, aqueous preparations of fatty alcohol-sulphates contain, as viscosity modifiers, short-chain sulphates or sulphonates, such as, for example, alkyl-sulphates with 1–6 C atoms in the hydrocarbon chain, monosulphates or polysulphates of pentaerythritol, or acetonedisulphonic acid. It is also known that inorganic salts such as NaCl or ammonium salts or low molecular alcohols can have a viscosity-lowering action. Finally, Chem. Z. 96 (1972), 248 describes that so-called structure breakers, compounds containing amide groups, such as urea, methylacetamide and similar substances, are suitable for lowering the viscosity of liquid preparations of anionic or non-ionic surface-active agents.

In all cases it is a matter of lowering the viscosities of anionic or non-ionic surface-active agents by adding anionic compounds or compounds containing acid groups, or by inorganic salts or non-ionic organic substances.

German Auslegeschrift (German Published Specification) No. 1,940,538 describes aqueous solutions, for the treatment of textile fibres, which contain a cationic agent in the form of a salt which dissociates in solution to form a cationic surface-active agent, an anionic agent and—because of the incompatibility of the two types of surface-active agents—added amphoteric substances.

As already mentioned above, fatty acid-alkanolamine condensates always contain certain amounts of amino-esters or ester-amides, which are to be regarded as cationic surface-active agents. Surprisingly, it has now been found that readily water-soluble aqueous preparations of such condensation products are obtained by addition of certain anionic compounds. The addition of the anionic compounds does not adversely influence the known good effects of the condensates on textiles.

The subject of the invention are liquid, aqueous preparations of fatty acid/alkanolamine condensates which contain a sulphuric acid ester of the general formula $$R—X—OSO_3^{(-)}\,M^{(+)} \qquad \text{I}$$

wherein

R denotes a saturated or unsaturated, straight-chain or branched, aliphatic radical with 8–22 C atoms, an alkylphenyl radical with 4–12 C atoms in the alkyl chain or a naphthyl radical, X denotes a polyglycol ether chain which is derived from ethylene oxide or propylene oxide or mixtures of both, and wherein the number of chain members is 10–30 and $M^{(+)}$ denotes a metal of main group 1 or an ammonium ion, preferably in amounts of 10–30% calculated relative to the fatty acid/alkanolamine condensate employed. By addition of this sulphuric acid ester it proves possible substantially to lower the viscosity of the aqueous preparations. The fatty acid/alkanolamine condensates can be present in high concentration, for example up to 50% by weight, in the aqueous preparation. Preparations which contain 10–25% by weight of the condensates are preferred.

Sulphuric acid esters of the formula I in which

R represents an alkyl or alkenyl radical with 8–22 C atoms or an alkylphenyl radical with 4–12 C atoms in the alkyl radical, X represents a polyethylene glycol chain with 14–20 units and $M^{(+)}$ represents $Na_{(+)}$, $K^{(+)}$, $NH_4^{(+)}$ or mono-, di- or tri-ethanolammonium or -propanolammonium have proved particularly advantageous.

A further subject of the invention is the use of sulphuric acid esters of the general formula $$R—X—OSO_3^{(-)}\,M^{(+)} \qquad \text{I}$$

wherein

R denotes a saturated or unsaturated, straight-chain or branched, aliphatic radical with 8–22 C atoms, an alkylphenyl radical with 4–12 C atoms in the alkyl chain or a naphthyl radical, X denotes a polyglycol ether chain which is derived from ethylene oxide or propylene oxide or mixtures of both, and wherein the number of chain members is 10–30 and $M^{(+)}$ denotes a metal of main group 1 or an ammonium ion for lowering the viscosity of aqueous preparations of fatty acid/alkanolamine condensates which are active as textile softeners and antistatic agents.

By fatty acid/alkanolamine condensates there are to be understood substances or mixtures of substances which are prepared by reaction of straight-chain or branched, saturated or unsaturated, fatty acids with 10 to 22 carbon atoms in the alkyl chain, such as, for example, lauric acid, palmitic acid, stearic acid, behenic acid or oleic acid, or technical mixtures of such fatty acids, as obtained from splitting the fat of natural oils and fats, such as coconut oil, palm kernel fat, beef tallow, soya oil, cottonseed oil and the like, with alkanolamines, such as, for example, ethanolamine, diethanolamine, triethanolamine, i-propanolamine, di-i-propanolamine, tri-i-propanolamine, N-methyl-diethanolamine, methylethanolamine or the like at molar ratios of fatty acid to alkanolamine of 2:1 to 1:1, by elimination of water at temperatures between 120° and 200° C. under normal pressure or reduced pressure.

The sulphuric acid esters which lower the viscosity are prepared in a known manner as described, for example, in German Pat. Spec. No. 605,973 or U.S. Pat. Spec. Nos. 2,637,740 and 2,647,913, by reaction of fatty alcohol polyglycol ethers or alkylphenol polyglycol ethers with customary sulphating agents, such as chlorosulphonic acid, sulphur trioxide, amidosulphonic acid or the like.

The polyglycol ether base materials are prepared by a known reaction of 10–30 mols of ethylene oxide or propylene oxide or mixtures thereof with one mol of a straight-chain or branched, saturated or unsaturated alcohol with 8–22 C atoms, such as, for example, octyl alcohol, lauryl alcohol, stearyl alcohol, oleyl alcohol or an alcohol, or mixture of alcohols, obtained by the reduction of natural fatty acid esters, by the oxosynthesis or by the Ziegler process, or with one mol of an alkylphenol which contains 4–12 C atoms in the straight or branched aliphatic side chain, such as, for example, i-octylphenol, i-nonylphenol or n-dodecylphenol. The sulphation products of the adducts of oleyl alcohol and 20 mols of ethylene oxide, i-nonylphenol and 20 mols of ethylene oxide or lauryl alcohol and 16 mols of ethylene oxide, in the form of their diethanolammonium salts, are particularly active in the sense of the invention.

In addition to the viscosity-lowering substances, the preparations can contain non-ionic surface-active agents, of the type of the polyglycol esters or polyglycol ethers, for the purpose of improving the solubility. Substances which are obtained by the reaction of fatty acids with 8–22 C atoms, such as, for example, capric acid, lauric acid, palmitic acid, stearic acid, behenic acid, oleic acid or technical mixtures of such fatty acids, or fatty alcohols with 10–18 C atoms, such as, for example, lauryl alcohol, stearyl alcohol or so-called coconut fatty alcohols, or α-methyl-branched fatty alcohols, such as are commercially available under the name "Dobanol", with alkylene oxides, such as, for example, ethylene oxide or propylene oxide, have proved of value. The reaction products of stearic acid and 6 mols of ethylene oxide, lauric acid and 6 mols of ethylene oxide or lauryl alcohol and 6 mols of ethylene oxide have proved of particular value.

The liquid preparations are produced by melting fatty acid/alkanolamine condensates together with the viscosity-lowering additives and, where relevant, with non-ionic surface-active agents at 70°–80° C. and stirring the requisite amount of warm water into the aqueous melt. After 30 minutes, the batch is cooled to room temperature whilst stirring and a mobile preparation which is miscible with water in all proportions is obtained.

There now follows the description of the preparation of the fatty acid/alkanolamine condensates and viscosity-lowering sulphuric acid esters used in the examples.

Condensate A 95 g of diethanolamine are added slowly to 270 g of technical grade stearic acid (5% by weight of $C_{12-14}$; 25% by weight of $C_{16}$; 70% by weight of $C_{18}$) at 160°–170° C. The batch is then stirred for 120 minutes at 170°–180° C. under atmospheric pressure, followed by 300 minutes at 40–60 mm Hg, in the course of which 25 g of water are eliminated. The acid number of the waxy, cream-coloured reaction product is 1.5.

Condensate B 149 g of triethanolamine are added slowly to 270 g of technical grade stearic acid (2% by weight of $C_{12-14}$; 25% by weight of $C_{16}$; 71% by weight of $C_{18}$; 2% by weight of $C_{20}$) at 160°–170° C. The batch is then stirred for 120 minutes at 170°–180° C. under atmospheric pressure, followed by 420 minutes at 40–60 mm Hg, in the course of which 20 g of water are eliminated. The acid number of the waxy reaction product, which in the liquid state is honey-coloured, is 0.85.

Condensate C 133 g of di-i-propanolamine are added to 242 g of palm kernel fatty acid (10% by weight of $C_{10}$; 49% by weight of $C_{12}$; 14% by weight of $C_{14}$; 8% by weight of $C_{16}$; 19% by weight of $C_{18}$) at 160°–170° C. The batch is then stirred for 120 minutes at 170°–180° C. under atmospheric pressure, followed by 360 minutes at 40–60 mm Hg, in the course of which 24 g of water are eliminated. The acid number of the waxy, cream-coloured reaction product is 1.6.

Condensate D 105 g of diethanolamine are added slowly to 374 g of behenic acid at 170°–180° C. The batch is then stirred for 120 minutes at 170°–180° C. under atmospheric pressure, followed by 300 minutes at 40–60 mm Hg, in the course of which 29 g of water are eliminated. The acid number of the waxy reaction product is 1.1.

Condensate E 105 g of diethanolamine are added slowly to 231 g of hydrogenated coconut fatty acid (8% by weight of $C_8$; 7% by weight of $C_{10}$; 48% by weight of $C_{12}$; 18% by weight of $C_{14}$; 9% by weight of $C_{16}$; 10% by weight of $C_{18}$) at 160°–170° C. The batch is then stirred for 120 minutes at 170°–180° C., in the course of which 23 g of water are eliminated. The waxy, cream-coloured product has an acid number of 0.9.

Sulphuric acid ester 1

311 g of the reaction product of 1 mol of oleyl alcohol and 20 mols of ethylene oxide are warmed to 40° C. 32 g of chlorosulphonic acid are then introduced slowly into the clear melt at the same temperature. Thereafter the batch is stirred for 120 minutes at the same temperature. To neutralise it, the reaction product is forced into a solution of 58 g of diethanolamine in 1,420 g of desalinated water and the mixture is stirred until a clear solution is obtained. The pH value of a 1% strength aqueous solution is 7.0. The yield is 1,820 g of a honey-coloured liquid. The degree of sulphation is 69.2%.

Sulphuric acid ester 2

574 g of the reaction product of 1 mol of oleyl alcohol with 20 mols of ethylene oxide are warmed to 80° C. and 49 g of amidosulphonic acid are added in portions, with vigorous stirring. The reaction is complete as soon as the amidosulphonic acid has dissolved, which requires approx. 3–4 hours. The reaction product is dissolved in 2,200 g of warm water and adjusted in a pH value of 7.5 with 25% strength ammonium hydroxide solution. The degree of sulphation is 68.3%.

Sulphuric acid ester 3

29 g of chlorosulphonic acid are added slowly, whilst stirring, to 275 g of the reaction product of 1 mol of i-nonylphenol and 20 mols of ethylene oxide at 40° C. After completion of the addition, the batch is stirred for 120 minutes at 40° C. 220 g of the reaction product are then introduced into a solution of 40 g of diethanolamine in 912 g of water and the mixture is stirred to form a solution. The pH value of the yellowish liquid is 7.3, and the degree of sulphation is 64.7%.

Sulphuric acid ester 4

29 g of chlorosulphonic acid are added slowly, whilst stirring, to 222.5 g of the reaction product of 1 mol of lauryl alcohol with 16 mols of ethylene oxide at 40° C. After completion of the addition, the batch is stirred for 120 minutes at 40° C. 220 g of the reaction product are then introduced into a solution of 51 g of diethanolamine in 940 g of water and the mixture is stirred to form a clear solution. The pH value of the slightly coloured liquid is 7.3, and the degree of sulphation is 57.2%.

Sulphuric acid ester 5

29 g of chlorosulphonic acid are added slowly, whilst stirring, to 271.5 g of the reaction product of 1 mol of technical grade lauryl alcohol, average molecular weight 206, with 20 mols of ethylene oxide, at 40° C. After completion of the addition, the batch is stirred for 120 minutes at the same temperature. Thereafter, 220 g of the reaction product are dissolved, whilst stirring, in 890 g of 3% strength aqueous potassium hydroxide solution. The pH value of a 1% strength aqueous solution is 7.4, and the degree of sulphation is 63.3%.

Sulphuric acid ester 6

29 g of chlorosulphonic acid are added slowly, whilst stirring, to 271.5 g of the reaction product of 1 mol of technical grade lauryl alcohol, average molecular weight 206, with 20 mols of ethylene oxide, at 40° C. After completion of the addition, the batch is stirred for 120 minutes at 40° C. Thereafter, 220 g of the reaction product are introduced into a mixture of 49 g of diethanolamine and 925 g of water and stirred until a clear yellowish solution is formed. The pH value of a 1% strength aqueous solution is 7.2, and the degree of sulphation is 59.5%.

The table which follows shows the viscosities of preparations 3–10 according to the invention, and those of preparations 1 and 2, which are not according to the invention.

| Example | 1 | 2 | 3 | 4 | 5 | 6 | 7 | 8 | 9 | 10 |
|---|---|---|---|---|---|---|---|---|---|---|
| Condensate A | 16 | 16 | | | | | 16 | 16 | 16 | 16 |
| Condensate B | | | 16 | | | | | | | |
| Condensate C | | | | | 16 | | | | | |
| Condensate D | | | | | | 16 | | | | |
| Condensate E | | | | 16 | | | | | | |
| Sulphuric acid ester 1 | | | | | | | 18.2 | | | |
| Sulphuric acid ester 2 | | | 18.2 | | | | | | | 18.2 |
| Sulphuric acid ester 3 | | | | 18.2 | | | | | | |
| Sulphuric acid ester 4 | | | | | 18.2 | | | | 18.2 | |
| Sulphuric acid ester 5 | | | | | | 18.2 | | | | |
| Sulphuric acid ester 6 | | | | | | | | 18.2 | | |
| Oleyl alcohol + 20 ethylene oxide | 4 | | | | | | | | | |
| Technical lauryl alcohol + 20 ethylene oxide | | 4 | | | | | | | | |
| Stearic acid + 6 ethylene oxide | 2 | 2 | 2 | 2 | 2 | 2 | 2 | 2 | 2 | 2 |
| $H_2O$ | 78.0 | 78.0 | 63.8 | 63.8 | 63.8 | 63.8 | 63.8 | 63.8 | 63.8 | 63.8 |
| Viscosity, sec. | Paste | Paste | 9.0 | 5.5 | 7.4 | 10.2 | 8.0 | 8.2 | 9.2 | 9.0 |
| Permeability % | 80 | 78 | 76 | 64 | 72 | 74 | 80 | 80 | 72 | 79 |

The figures in the table denote % by weight. The viscosities recorded are seconds required for 50 g of substance to flow through a Ford cup when using a 4 mm nozzle at room temperature. The permeabilities were determined on 1% strength aqueous solutions using a Photoelectric Colorimeter from Messrs. Cenco.

The table shows that only when using the sulphated polyglycol ethers are liquid products obtained, whilst the use of the analogous polyglycol ethers gives pasty products.

The effects of the fatty acid/alkanolamine condensates in textile technology, for example the softening or antistatic action on natural and synthetic textile materials such as cotton and polyamide, are not impaired by replacing the polyglycol ethers in known preparations by the corresponding sulphuric acid esters.

The liquid form of the mixtures according to the invention and their ready solubility permit rational handling when they are used industrially.

Use example 1

A solution containing 2 g/l is prepared by pouring water at 30°–35° C. over the product described in Example 7. Cotton knitted goods are introduced into this solution, using a liquor ratio of 1:20. After 20 minutes, the goods are centrifuged off to a residual moisture content of 40–50% and dried at 110° C. A material having a smooth, full handle is thus obtained.

Use example 2

An aqueous solution which receives the following additives per liter is prepared: 2 g of the product of Example 8, 2 ml of NaOH of 38° Bé, 1 g of a detergent comprising a mixture of a Mersolat and a condensation product of nonylphenol with ethylene oxide, and 5 ml of 35% strength $H_1O_2$.

Cotton towelling is treated with this solution, using a liquor ratio of 1:5, for 40 minutes at 85° C., 30 minutes at 90° C. and 30 minutes at 95° C. The towelling is then rinsed hot, warm and cold, centrifuged off and dried. This gives a high-yield bleaching effect and a material having a pleasant soft handle.

What is claimed is:

1. In a process for reducing the viscosity of an aqueous preparation of an anti-static agent or textile softener consisting essentially of a fatty acid/alkanolamine condensate containing cationic surface active agents consisting of amino-esters and ester-amides, the improvement comprising incorporating a sulfuric acid ester of the formula $$R—X—OSO_3^{(-)}M^{(+)}$$

wherein

R is a saturated or unsaturated, straight-chain or branched, aliphatic radical with 8–22 C atoms, an alkylphenyl radical with 4–12 C atoms in the alkyl chain, or a naphthyl radical;

X is a polyglycol ether chain which is derived from ethylene oxide or propylene oxide or mixtures thereof, and wherein the number of chain members is 10–30; and $M^{(+)}$ is a metal of main group 1 or an ammonium ion into the aqueous preparation of said anti-static agent or textile softener, in an amount of from 10–30% by weight of sulfuric acid ester based on the weight of fatty acid/alkanol amine condensate, to provide a mobile preparation miscible with water in all proportions.

2. The process in claim 1, wherein the fatty acid/alkanol amine condensation product is present in an amount of from 10–25% by weight of said product mobile preparation.

3. The process of claim 1, wherein a non-ionic surface-active agent is also incorporated into the aqueous preparation.

4. The process of claim 2, wherein the sulfuric acid ester is incorporated into the aqueous preparation of the anti-static agent or textile softener by melting the sulfuric acid ester together with the fatty acid/alkanol amine condensate at 70° to 80° C. and admixing warm waer with the aqueous melt.

* * * * *